US005944173A

United States Patent [19]

Boire et al.

[11] Patent Number: 5,944,173

[45] Date of Patent: Aug. 31, 1999

[54] SECURITY PACKAGE FOR DISPLAYING MERCHANDISE IN A RETAIL STORE

[75] Inventors: William A. Boire, Shorewood; Mark A. Bongard, Excelsior; Stanley R. Buisman, Brooklyn Park, all of Minn.

[73] Assignee: Emplast, Inc., Waconia, Minn.

[21] Appl. No.: 09/092,447

[22] Filed: Jun. 5, 1998

[51] Int. Cl.[6] ..... A45C 13/10; B65D 55/02

[52] U.S. Cl. ..... 206/1.5; 70/63; 206/308.2; 206/387.11; 206/807; 220/835

[58] Field of Search ..... 206/1.5, 308.2, 206/387.11, 807; 70/57.1, 63; 220/326, 830, 835

[56] References Cited

U.S. PATENT DOCUMENTS

| | | | |
|---|---|---|---|
| D. 343,356 | 1/1994 | Wittman . | |
| 3,351,270 | 11/1967 | Hohnjec | 220/835 |
| 4,223,787 | 9/1980 | Lowry et al. . | |
| 4,469,225 | 9/1984 | Takahashi | 206/1.5 X |
| 4,558,782 | 12/1985 | Iverson et al. . | |
| 4,746,008 | 5/1988 | Heverly et al. . | |
| 4,771,888 | 9/1988 | Lundeen . | |
| 4,804,082 | 2/1989 | Stein . | |
| 4,805,769 | 2/1989 | Soltis et al. . | |
| 5,205,401 | 4/1993 | Weisburn et al. | 206/1.5 |
| 5,390,515 | 2/1995 | Essick | 70/63 |
| 5,601,188 | 2/1997 | Dressen et al. . | |
| 5,762,187 | 6/1998 | Belden, Jr. et al. | 206/308.2 |
| 5,782,350 | 7/1998 | Weisburn et al. | 206/308.2 |
| 5,823,341 | 10/1998 | Nakasuji | 206/387.11 |

*Primary Examiner*—Bryon P. Gehman
*Attorney, Agent, or Firm*—Nikolai, Mersereau & Dietz, P.A.

[57] ABSTRACT

A security package for use in a retail setting has a pair of members hinged together that can be rotated about the hinge between an open and closed position. A lock is also provided to secure the two members in the closed position. A plurality of ribs are provided to reinforce the side walls of the two members and interlocks are provided on each member which cooperate to cover the edges of the side walls when the package is closed to prevent unauthorized opening of the package by prying apart the side walls.

7 Claims, 5 Drawing Sheets

SECURITY PACKAGE FOR DISPLAYING MERCHANDISE IN A RETAIL STORE

BACKGROUND OF THE INVENTION

I. Field of the Invention

The present invention relates to a package with a lock. More specifically, the present invention provides such a package ideally suited for cost effectively displaying a variety of items in a retail setting and protecting such items from theft.

II. Description of the Prior Art

A variety of techniques are used in retail settings to display items for sale and protect such items from theft. One technique often used is to attach the merchandise to a display shelf or rack using a strap, chain, cord or the like. Another technique is to display the merchandise in large glass display cabinets that are kept locked. This technique is often used in jewelry stores. Both of these techniques are effective in protecting the merchandise, but require the presence of store personnel to open the display cabinet or unlock the strap, chain or cord at the display point. This can result in lost sales if store personnel are not immediately available to assist the customer, particularly if impulse rather than need is driving the purchasing decision.

A third technique often used is to place items in oversized packaging. The oversized package, particularly if it is difficult to open, can be a significant deterrent to shoplifting. However, this technique does increase packaging costs. In recent years, this technique has been used in connection with the merchandising of audio tapes and compact discs. To reduce costs, various manufacturers have developed reusable packages that are intended to be quickly removed by a sales clerk operating one of the store's cash registers. Such a package is, for example, disclosed in U.S. Pat. No. 4,865,190. While such packages significantly reduce theft, they are specifically designed for use with a single type of product, e.g. compact discs.

A fourth technique often used today is to equip all exits to the store with sensors coupled to an alarm. Special tags are then attached to each article of merchandise. The tags on items purchased are deactivated at the cash register so they will not trigger the alarm as a purchased item leaves the store. Any tag not deactivated will trigger the alarm. This technique is, again, an effective means for reducing theft. However, a clever thief will be able to find ways to deactivate the tag. Such a thief can also remove the tag from the package, particularly if the tag has been attached using an adhesive to shrink wrap plastic film surrounding a box. Still another problem with this technique is the cost of the tags, each of which leaves the store with the merchandise to which it is attached. Recognizing this problem, applicant's assignee recently introduced reusable plastic packaging for compact discs, audio tapes and video cassettes. This packaging includes a compartment for storing an electronic article surveillance tag. Thus, when the package is removed by the cashier, the tag stays with the package and can be reused with the package. The tag is placed in the package so that it cannot be quickly removed by a thief. It is also positioned in such a way that a thief cannot easily deactivate the tag. Packages of this type are described in U.S. Pat. No. 5,601,188.

While packages of the type described in U.S. Pat. No. 5,601,188 are ideally suited for cost effectively protecting compact discs, audio tapes and video cassettes, there is a need for a package having the same benefits but having broader applicability. More specifically, there is a need for such a package that can be used to display and secure a variety of items including, but not limited to jewelry, watches, computer software, tools, printer cartridges, pen and pencil sets, hand-held calculators, laptop or palmtop computers, audio video equipment and the like.

SUMMARY OF THE INVENTION

The present invention provides a reusable security package designed for a variety of applications. The security package is preferably made of a clear plastic material so that its contents are visible through the package. The security package also has a lock for preventing removal of the contents from the package except by store personnel possessing a key. The package also incudes a chamber for retaining an electronic article surveillance tag. Various other structures are also a part of the package to prevent tampering and theft of package's contents.

DETAILED DESCRIPTION OF THE PREFERRED EMBODIMENTS

Figure 1:
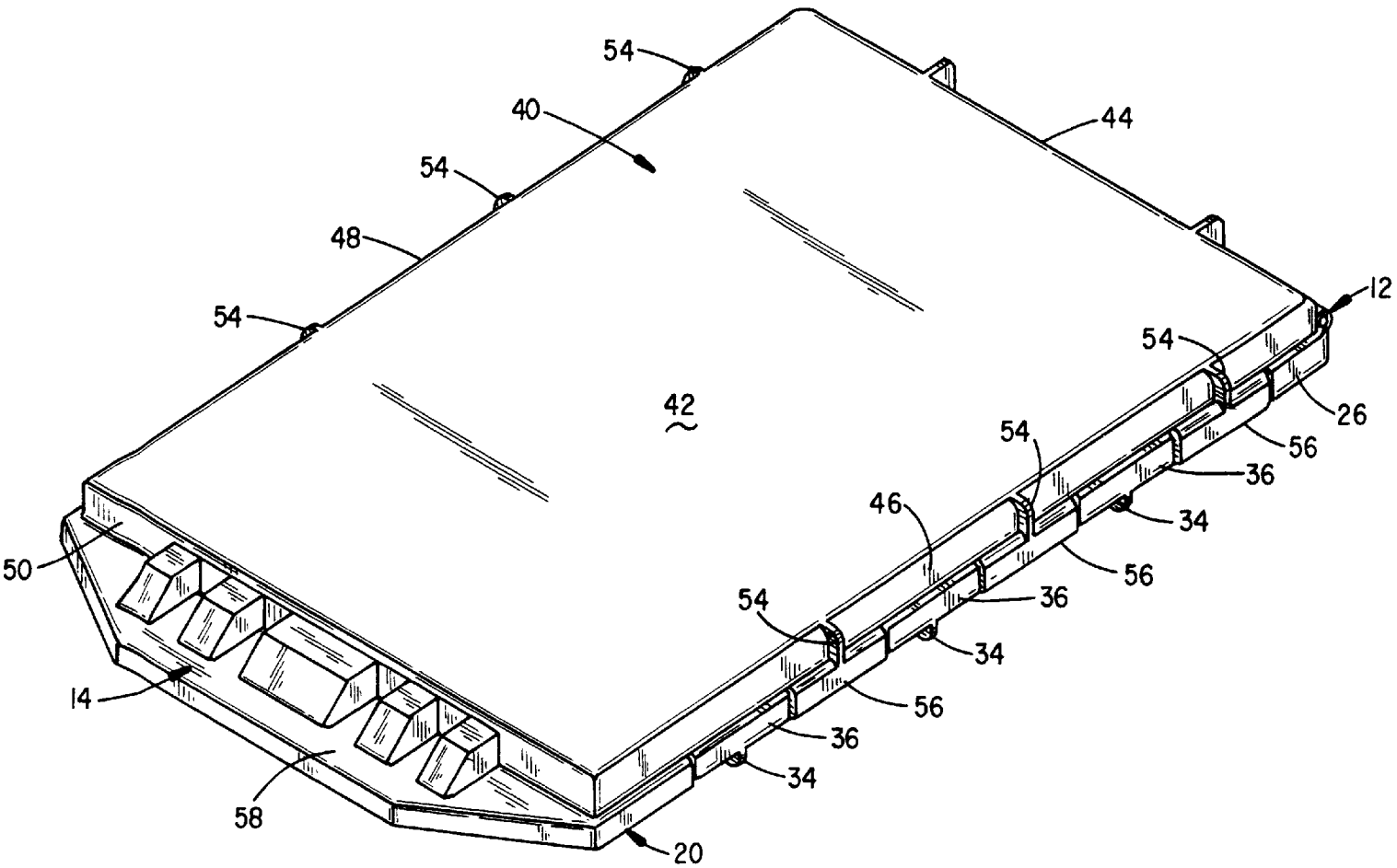
FIG. 1 is a perspective view of a security package made in accordance with the present invention in its closed position.

Referring initially to FIG. 1, shown in perspective is a preferred embodiment of the present invention comprising a security package 10 incorporating a bottom member 20 and a top member 40. The package 10 has a clamshell design. As such, the top member 40 and bottom member 10 are joined together and pivot with respect to each other about a hinge arrangement designated generally as 12. The hinge arrangement is located at one end of the top member 40 and the bottom member 20. Located at the other end is lock arrangement 14.

As shown in the drawings, the bottom member 20 has a base 22, a back wall 24, a pair of side walls 26 and 28, and a front wall 30. Each side wall 26 and 28 has a top edge 32, a plurality of ribs 34 projecting outwardly from the wall, and a plurality of side wall interlocks 36 spaced from each other that project outwardly and upwardly past the top edge 32.

The top member 40 has a similar design. Specifically, the top member 40 has a base 42, a back wall 44, a pair of side walls 46 and 48, and a front wall 50. Each side wall 46 and 48 has a bottom edge 52, a plurality of ribs 54 projecting outwardly from the wall, and a plurality of side wall interlocks 56 that are spaced from each other and project outwardly and downwardly past the bottom edge 52.

Figure 2:
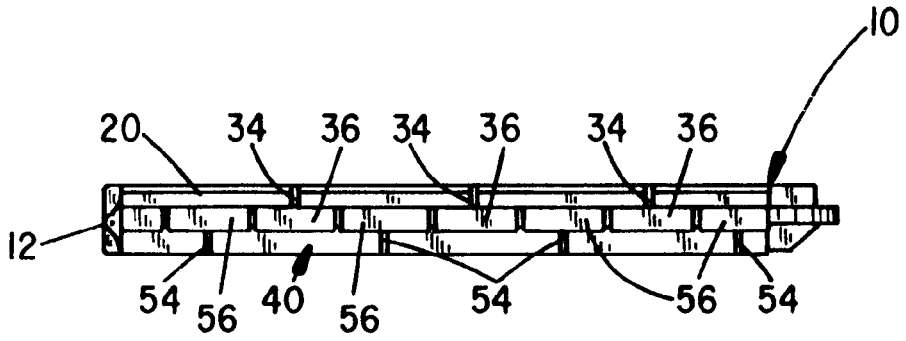
FIG. 2 is a side elevational view of the security package of FIG. 1 in its closed position.
Figure 3:
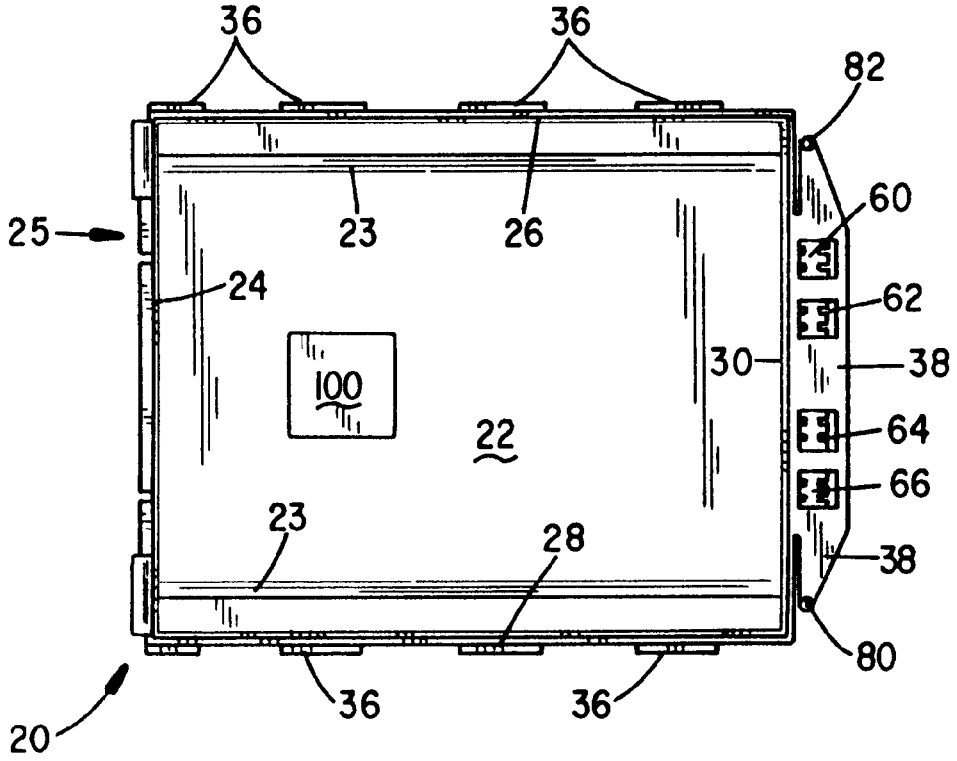
FIG. 3 is a top plan view of the bottom member of the security package shown in FIG. 1.
Figure 4:
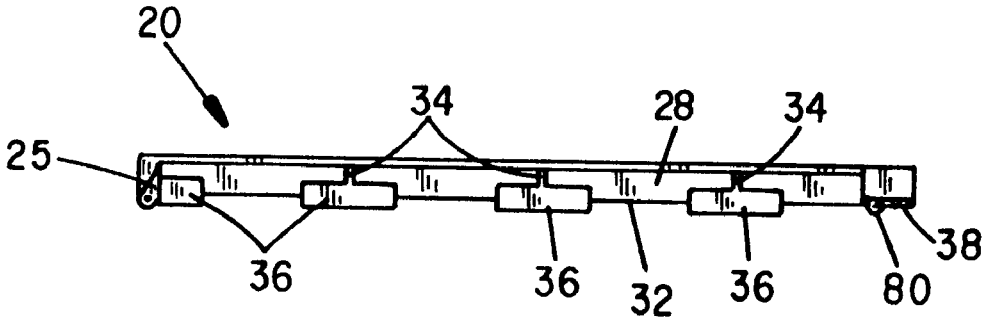
FIG. 4 is a side elevational view of the bottom member of said security package.
Figure 5:
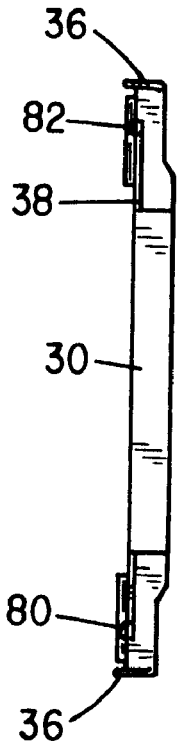
FIG. 5 is an end elevational view of the bottom member of said security package.
Figure 6:
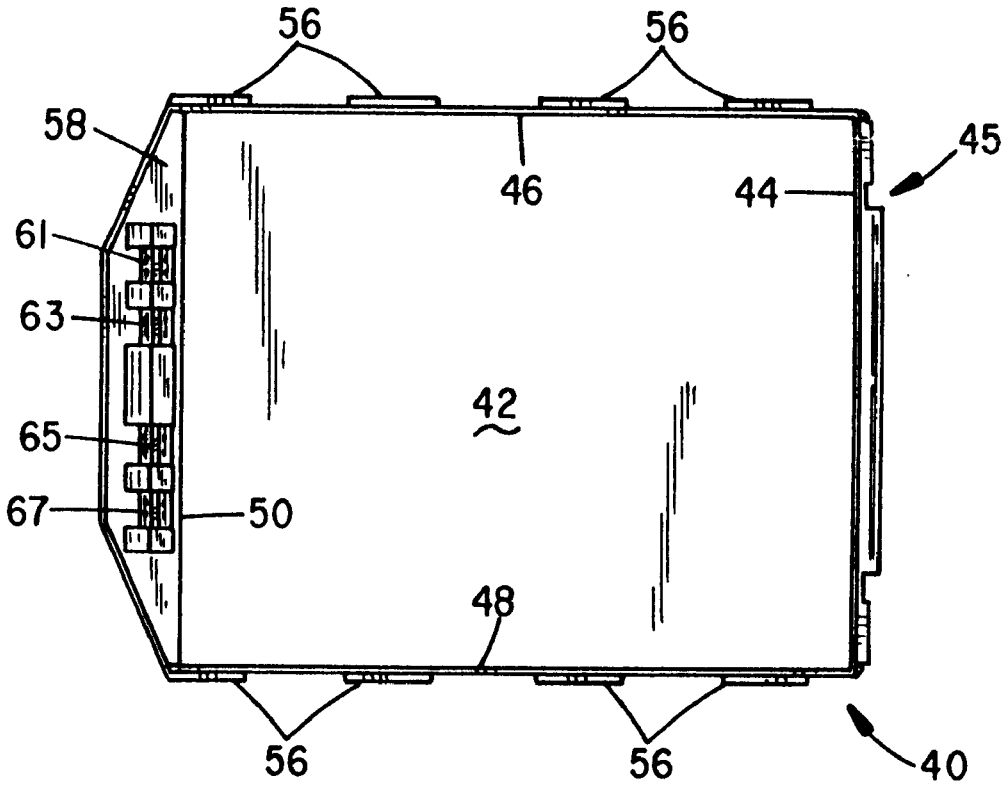
FIG. 6 is a bottom plan view of the top member of said security package.
Figure 7:
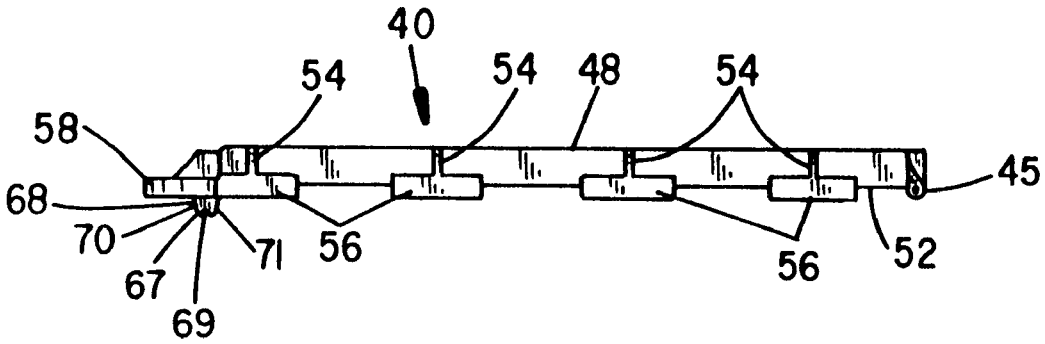
FIG. 7 is a side elevational view of the top member of said security package.
Figure 8:
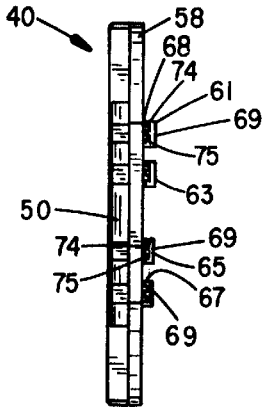
FIG. 8 is an end elevational view of the top member of said security package.

As best shown in FIG. 2, when the package 10 is closed and locked, the interlocks 56 and 36 are interlaced. Given this design, the ribs 34 and 54, in combination with the interlocks 36 and 56, strengthen the side walls and prevent the side walls from being pried apart to create an opening through which the contents of the package can be removed.

Projecting from the front wall 30 of the bottom member 20 is a lock plate 38. A similar lock plate 58 projects from the front wall 50 of the top member 40. The lock arrangement 14 comprises the lock plates 38 and 58 and the structures formed therein.

The lock plate 38 includes four engagement apertures 60, 62, 64 and 66. Each engagement aperture includes four teeth that extend downwardly and inwardly. The lock plate 58 includes four engagement members 61, 63, 65 and 67. Each engagement member protrudes in a generally perpendicular fashion from the lock plate 58 and are spaced so that each is aligned with one of the apertures 60, 62, 64 and 66. Each engagement member includes a generally rectangular base portion 68 integrally attached to a cap portion 69. The base portion has first and second longitudinal walls 70 and 71, and first and second lateral walls 72 and 73. Each longitudinal wall includes a pair of engagement channels 74 and 75. When locking the device, an engagement member is inserted into each of the four engagement apertures. Each of the four teeth associated with each aperture enter one of the four engagement channels of the engagement member and butt up against the cap preventing removal of the engagement members from the engagement apertures without the use of a key. Further details related to the structures of the engagement apertures, teeth, engagement members, and engagement channels are provided by U.S. Pat. No. 5,601,188 which is hereby incorporated by reference.

To prevent inadvertent locking of the device, two spring elements 80 and 82 are provided at opposite ends of the lock plate 38. The force of spring elements 80 and 82 must be overcome before the engagement members and engagement apertures become fully engaged to lock the device. Also, to prevent someone from attempting to pry the lock open, the lock plate 58 extends past the lock plate 38 and has a downwardly projecting lip 59 that overlaps and covers the edge of lock plate 38.

The security package 10 is sufficiently large that it will not conveniently fit in a pants or jacket pocket. This serves as one deterrent to shoplifting. To provide an additional deterrent, the package can include an electronic surveillance tag 100 capable of triggering a store alarm if one tries to exit the store with the package. Electronic surveillance tags and associated alarm systems are well known in the art. The electronic surveillance tag 100 incorporated as part of the package 10 can be embedded within the material from which either the top member 40 or bottom member 20 is formed. Alternatively, the package 10 can include a separate chamber (not shown) in which the tag 100 is positioned to prevent tampering. Most likely, however, the tag 100 will be secured to either the top member 40 or bottom member 20 so that the tag is situated between the top member 40 and bottom member 20 when they are in the closed and locked position. One way to secure the tag 100 in this fashion is through the use of a suitable adhesive. As shown in the drawings, the base 22 of bottom member 20 has a level change 23 to produce a recess into which the security tag 100 can be placed.

As indicated above, the security package 10 includes various structures to prevent access to merchandise contained within the package. These structures include the ribs 34 and 54, the side wall interlocks 36 and 56, the lip 59 on lock plate 58 which covers the edge of lock plate 38 when the device is locked, and the locking members and apertures. One other feature of the package 10 to prevent unwanted access to the package is the design of the hinge arrangement 12.

Figure 9:
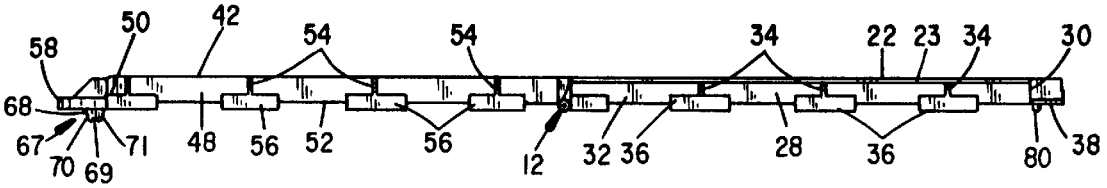
FIG. 9 is a side elevational view of the bottom member and the top member joined together by a huge member to form a clamshell arrangement.

As shown in the drawings, the hinge arrangement 12 includes a first set of hinge elements 25 projecting from the back wall 24 of the bottom member 20 and a second set of hinge elements 45 projecting from the back wall 44 of the top member 40. The hinge elements 25 and 45 cooperate to form the bottom member 20 and top member 40 into a clam shell arrangement so that the two members can rotate about the hinge arrangement 12 between an open position shown in FIG. 9 and a closed position shown in FIGS. 1 and 2. To prevent tampering with the hinge arrangement 12, the exposed profiles of the hinge elements 25 and 45 are sculpted rather than squared off. This reduces the possibility that one could break or cut the hinge arrangement 12 using a hand tool such as a cutter or pliers. Further, the hinge pins of the hinge arrangement 12 are recessed into receiving holes and are prevented from being pushed out of the part by a solid wall of plastic. Thus, the hinge pins cannot be gripped to pull them out. They also cannot be pushed out because of the solid plastic wall.

In summary, the combination of the present invention provides a very secure package that is resistant to tampering.

It is claimed:

1. A security package for storing and displaying merchandise, said security package comprising:

(a) a first member having a first base, a first pair of side walls each projecting from said first base and terminating in an edge, a first front wall having a first lock plate projecting therefrom, a first back wall having first hinge means formed therewith, and a plurality of first side wall interlocks, each of said first side wall interlocks projecting outwardly from one of said first side walls and past said edge of said one first side wall;

(b) a second member having a second base, a second pair of side walls each projecting from said second base and terminating in an edge, a second front wall having a second lock plate projecting therefrom, a second back wall having second hinge means formed therewith for cooperating with said first hinge means so that the first member and second member can be pivoted with respect to each other between an opened position and a closed position, and a plurality of second side wall interlocks, each of said second side wall interlocks projecting outwardly from one of said second side walls and past the edge of said one second side wall, the spacing between said first side wall interlocks and the spacing between said second side wall interlocks being such that when the first member and the second member are in the closed position said first side wall interlocks are adjacent said second side wall interlocks so that said first side wall interlocks and said second side wall interlocks cooperate to substantially cover the edge of said one first side wall and the edge of said one second side wall; and (c) means associated with said first and second lock plates for locking said first member and said second member in said closed position.

2. The security package of claim 1 wherein said first member and said second member are made of a clear plastic material.

3. The security package of claim 1 wherein, when said security package is in its closed position, said first lock plate extends past said second lock plate and includes a lip that projects in the direction of said second lock plate to cover the end of the second lock plate.

4. The security package of claim 1 further including first and second spring means coupled to one of said lock plates for engaging the other lock plate to inhibit unintended locking of said first member and second member in said closed position.

5. The security package of claim 1 wherein said means associated with said first and second lock plates for locking said first member and said second member in said closed position comprises at least one engagement aperture including four teeth, and on said first lock plate at least one engagement member on said second lock plate, each engagement member comprising a base portion having a pair of opposing walls, a pair of engagement channels in each of said opposing walls, and a cap portion, each engagement member being aligned with an engagement aperture so that as the first member and second member are pivoted toward the closed position, the engagement member enters the engagement aperture and the teeth enter the engagement channels to engage the cap portion and lock the first member and the second member in the closed position.

6. The security package of claim 1 further comprising an electronic surveillance tag.

7. The security package of claim 6 when said electronic surveillance tag is secured to one of said first and second members and positioned so that it is between said first and second members when said first and second members are in the closed position.

* * * * *